United States Patent [19]

Schneider et al.

[11] Patent Number: 5,059,226

[45] Date of Patent: Oct. 22, 1991

[54] CENTRIFUGAL TWO-PHASE FLOW DISTRIBUTOR

[75] Inventors: Michael G. Schneider, Rockford, Ill.; William A. Byrd, Minneapolis, Minn.

[73] Assignee: Sundstrand Corporation, Rockford, Ill.

[21] Appl. No.: 427,374

[22] Filed: Oct. 27, 1989

[51] Int. Cl.[5] ..... B01D 45/12

[52] U.S. Cl. ..... 55/459.1; 137/561 A; 137/561 R

[58] Field of Search ..... 55/36, 459.1; 137/561 A, 561 R

[56] References Cited

U.S. PATENT DOCUMENTS

| | | | |
|---|---|---|---|
| 2,084,755 | 6/1937 | Young, Jr. | 137/561 A |
| 2,126,364 | 8/1938 | Witzel | 137/561 A |
| 2,804,882 | 9/1957 | Goodyer | 137/561 A |
| 4,085,776 | 4/1978 | Derrick, Jr. | 137/561 A |
| 4,147,479 | 4/1979 | Morse | 55/459.1 |
| 4,199,152 | 10/1978 | Koyama | 169/25 |
| 4,248,296 | 2/1981 | Jezek | 165/118 |
| 4,528,919 | 7/1985 | Harbolt et al. | 111/7 |
| 4,549,567 | 10/1985 | Horton | 137/561 A |
| 4,717,076 | 1/1988 | Notkin | 239/467 |

FOREIGN PATENT DOCUMENTS

| | | | |
|---|---|---|---|
| 740799 | 11/1955 | United Kingdom | 137/561 A |

OTHER PUBLICATIONS

Sporlan Catalog—"Refrigerant Distributors" Jun. 1975/Bulletin 20-10.

*Primary Examiner*—Jay H. Woo
*Assistant Examiner*—C. Scott Bushey
*Attorney, Agent, or Firm*—Antonelli, Terry, Stout & Kraus

[57] ABSTRACT

A static, centrifugal two-phase distributor (20) is constructed to distribute two-phase refrigerant equally on a mass basis to conduits (37) of evaporator circuits. The distributor (20) has an upper section (21) defining a swirl chamber (23) with a tangentially arranged inlet (28) and a lower section (25) in which are arranged curved guide vanes (39) on a hub (38) to divide equally to apertures (36) in an end wall (35) of the distributor (20) the liquid and vapor refrigerant phases separated centrifugally in the second chamber (23). The apertures (36) are connected to conduits (37) of the evaporator circuits.

10 Claims, 3 Drawing Sheets

CENTRIFUGAL TWO-PHASE FLOW DISTRIBUTOR

TECHNICAL FIELD

The present invention relates to a two-phase flow distributor and, more particularly, to a non-rotating (static), centrifugal distributor for use in a vapor cycle system (VCS) and which utilizes centrifugal phase separation to evenly distribute two phases of a refrigerant on a mass basis to parallel paths of an evaporator of the VCS under adverse gravity ("g") conditions.

BACKGROUND ART

Typically, a distributor in refrigeration systems receives two-phase refrigerant flow from an expansion valve and divides it equally to provide uniform feed to all circuits of an evaporator.

Each conduit of an evaporator in a refrigeration system must have an equal fluid mass flow rate of refrigerant among the conduits in order effectively to use the evaporator. For example, if during operation of the VCS with a ten-conduit capacitor, 99% of the liquid refrigerant were to flow in only two of the ten conduits, then only 20% of the evaporator's heat exchange area would be effectively utilized. A distributor is used for the purpose of rendering the mass flow to the evaporator paths uniform and thereby allow the size of the evaporator to be reduced.

Under adverse "g" conditions of the type encountered in aerospace applications, a poorly performing distributor can cause excessive cycling of the expansion valve, poor evaporator performance and compressor performance. Poor refrigerant distribution or unequal evaporator loading reduce coil capacity and contribute to flood back to the compressor.

Two-phase flow static and dynamic dividers or distributors in general for a variety of purposes, including use on refrigeration systems, have been known for some time. For instance, U.S. Pat. No. 4,085,776 shows a flow divider for liquids having solid materials suspended therein. A typical use for such a device is in the feeding of slurries to screening equipment where the liquid is to be discharged at several locations along a vibrating screen. Circular tanks were used in which the slurry was introduced tangentially in the upper portion of the tank where it underwent cyclonic mixing as it descended along the circular wall of the tank. To encourage uniform mixing, an annular flange was proposed to be located against the internal wall of the tank at a level below the inlet passages and above the discharge passages. As a result, the slurry closest to the wall was intended to move radially inwardly, with the flange producing turbulence and a mixing action in the outer regions of the liquid in the tank. In other words, distribution was achieved in this device by mixing rather than separating the phases.

U.S. Pat. No. 4,248,296 shows a distributor for mounting on the upper end of vertical condenser tubes in a falling film-type heat exchanger in which, for example, brine slurry can flow to form a falling film on the interior surfaces of the condenser tubes. A ferrule chamber includes a frusto-conical lower chamber and a spherically shaped upper chamber arranged tangentially to the frusto-conical lower chamber. One or more inlet orifices are provided in the head portion and open tangentially into the upper spherically shaped chamber to direct the fluid inwardly and downwardly into the ferrule chamber. The swirling fluid establishes an inward vortex so that a rotating, hollow cylindrical fluid film can flow down the interior surface of the associated condenser tube. Such an arrangement requires a ferrule chamber for each tube and does not concern itself with two-phase flow or an even distribution of two-phase flow to a plurality of evaporator tubes. Centrifugal action is used for wetting the condenser tubes.

Another form of two-phase flow divider is disclosed in U.S. Pat. No. 4,528,919. However, this apparatus was intended for distributing ammonia and ammonia vapor to the soil for fertilization of the soil. To accomplish this, a divider was proposed in which a fluid inlet was placed in fluid communication with two or more separate fluid outlets through fluid conduits. The multiphase fluid flowed through a fluid inlet chamber into contact with an apertured plate so that the multiphase flow could be divided in a plane perpendicular to the flow direction into multiple separate streamlets in order to flow through the fluid conduits. This apparatus was not concerned with use of the divider in adverse "g" conditions and did not propose a divider which assures even flow distribution under those conditions.

A conventional static two-phase refrigerant distributor of the type designated by the numeral 10 in FIG. 1, comprises a body or housing 11 having an inlet 12 adapted to be connected downstream of a conventional expansion valve (not shown). The body 11 is provided with a series of passages 13 (only two of which are shown) distributed evenly therearound and to which tubing 14 communicating with the heat exchanger circuits of a direct expansion evaporator (also not shown) are connected. A geometrical divider 15 having a cone shape is arranged upstream of the passages 13. A removable nozzle 16 is held in the inlet section 12 of the body 11 by a retainer ring 17. Two-phase flow was distributed at the exit of the expansion valve by impinging the flow on the geometrical flow divider 15 after passing the two phase flow through the nozzle 16.

The distributor of FIG. 1 is designed so that the liquid and vapor leaving the expansion valve enter the distributor independently. The nozzle orifice 18 increases the refrigerant velocity, thereby creating turbulence and a thorough mixing under normal "g" conditions. The mixed refrigerant continues to move at high velocity past the nozzle 16 where roughly equal proportions of the two-phase mixture are deflected by the geometrical divider 15 into each passageway 13 spaced evenly around the distributor body. The refrigerant is then conveyed by the connecting tubing 14 to each evaporator circuit.

The distributor nozzle provides high velocity and turbulence to the liquid and vapor refrigerant, key ingredients in mixing the liquid and vapor. The high velocity is accompanied by a pressure drop which causes additional liquid refrigerant to flash into vapor which increases turbulence and further homogenizes the mixture. The interchangeable nozzle permits flexibility in handling variations in evaporator applications such as load, range, evaporator temperature and different refrigerants.

This type of distributor has certain advantages. For example, it is compact and can be installed in almost any position. The interchangeable nozzle permits custom selection for any refrigerant or capacity. Air conditioning systems often employ thermostatic expansion valves with gas charged power elements. The pressure drop across the distributor in FIG. 1 provides a pressure drop to maintain the bulb colder than the diaphragm case for proper control. Furthermore, it is adaptable to any standard thermostatic expansion valve and can be applied to available multi-circuit evaporators. It must, however, always be oriented to one position, e.g. vertically, to provide proper distribution.

The jet impingement nozzle distributor is not deemed sufficient for adverse "g" conditions as are encountered in aircraft installations where a distributor will be oriented in any number of positions during the course of a flight. When the liquid refrigerant passes through the expansion valve, a portion of the refrigerant flashes into vapor resulting in a two-phase mixture at the valve outlet. By weight, the mixture is predominantly liquid; however, vapor occupies the greater volume. Thus, the liquid and vapor refrigerant tend to move at different velocities and separate into layers, with gravity pulling the heavier liquid to the bottom. Unless the distributor of FIG. 1 is maintained in a vertical position, the conduits on one side of the distributor will receive more liquid than the conduits on the other side.

Another type of distributor used in vapor cycle systems is dynamic in operation and, therefore, needlessly complex and susceptible to malfunctioning. These distributors use the general approach of distributing single phase flow rather than distributing two-phase flow. In particular, a throttle is provided upstream of each evaporator conduit path in the form of a needle or flow plate covering each conduit opening. The needles or plates are ganged together and actuated toward and away from the apertures by, for example, a linear stepper motor. In essence, each conduit has its own control valve which is actuated by feedback from some point in the flow cycle. However, the clearance between, on one hand, the needles or plates and, on the other hand, the apertures is critical in causing the refrigerant to flow equally among all the conduits. Although such a device permits the tight control of mass flow based upon its direct correlation with upstream pressure for a given flow area, the problems encountered with a dynamic system, including leaning of the needle and vibration, require careful manufacturing and adjusting procedures.

DISCLOSURE OF INVENTION

It is therefore an object of the present invention to provide a distributor which avoids the problems and disadvantages encountered in the prior art.

It is another object of the present invention to provide a distributor of greatly simplified construction in the form of a static centrifugal distributor for two-phase flow which avoids the need for expensive manufacturing procedures or for constant adjustment to assure adequate distribution of two-phase flow to evaporator circuits.

It is still another object of the present invention to utilize centrifugal separation produced by the momentum and density difference of the two-phase flow entering the distributor to effect even distribution of the two-phase refrigerant flow in a vapor cycle system without the need for complex movable valves which require much greater precision and adjustment.

It is yet another object of the present invention to provide a distributor of simple construction which operates substantially equally well in adverse gravity conditions such as the high "g" environments encountered in aircraft systems.

It is an object of the present invention to provide a distributor which assures a good distribution of a homogeneous mixture of liquid and vapor refrigerant even in unfavorable gravity conditions.

It is yet a further object of the present invention to distribute two-phase flow evenly by inducing centrifugal acceleration sufficiently greater than the local gravity field and using centrifugal phase separation evenly to distribute two-phase flow on a mass basis.

In the method and apparatus according to the present invention, two-phase flow enters the centrifugal phase separator through a tangential inlet to utilize a centrifugally induced acceleration which is sufficiently greater than the local gravity field. The liquid or denser phase flows to the wall of the phase separator and forms a film of even thickness along the wall. Both the liquid and vapor phases are then distributed to each of the parallel flow paths by the geometrical flow divider in the form of curved vanes distributed around a hub.

BRIEF DESCRIPTION OF THE DRAWINGS

These and other objects, features and advantages of the present invention will become more apparent to those skilled in this art from the following detailed description of the best mode for carrying out the invention when taken in conjunction with the accompanying drawings wherein.

BEST MODE FOR CARRYING OUT THE INVENTION

Figure 1:
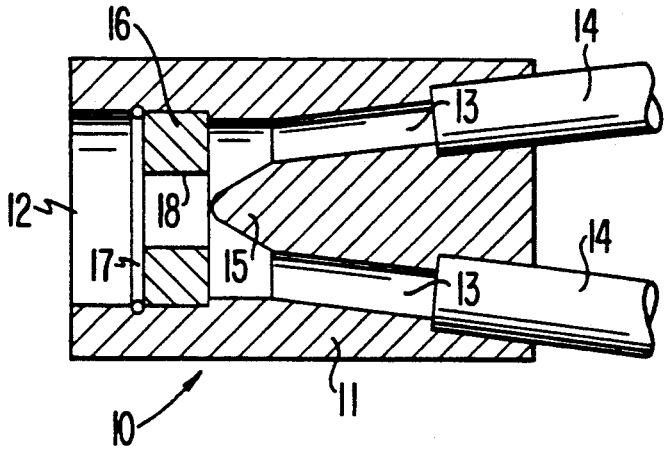
FIG. 1 PRIOR ART
FIG. 1 is a cross-sectional view of the prior art distributor previously described.
Figure 2:
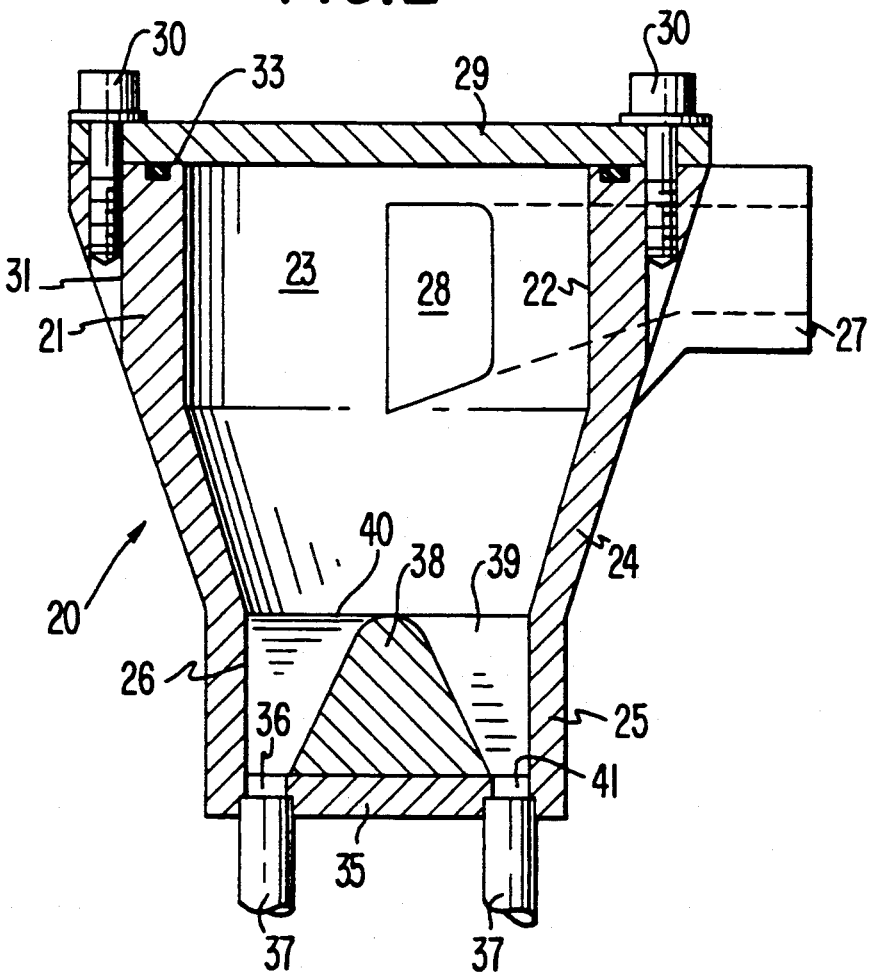
FIG. 2 is a cross-sectional view of the centrifugal, two-phase distributor of the present invention.
Figure 3:
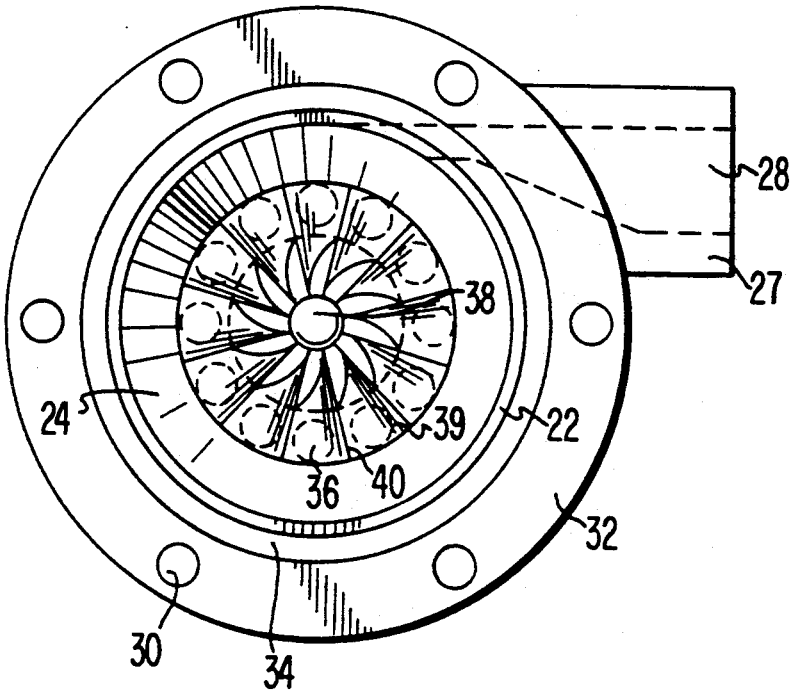
FIG. 3 is a top plan view of the distributor of the present invention shown in FIG. 2.
Figure 4:
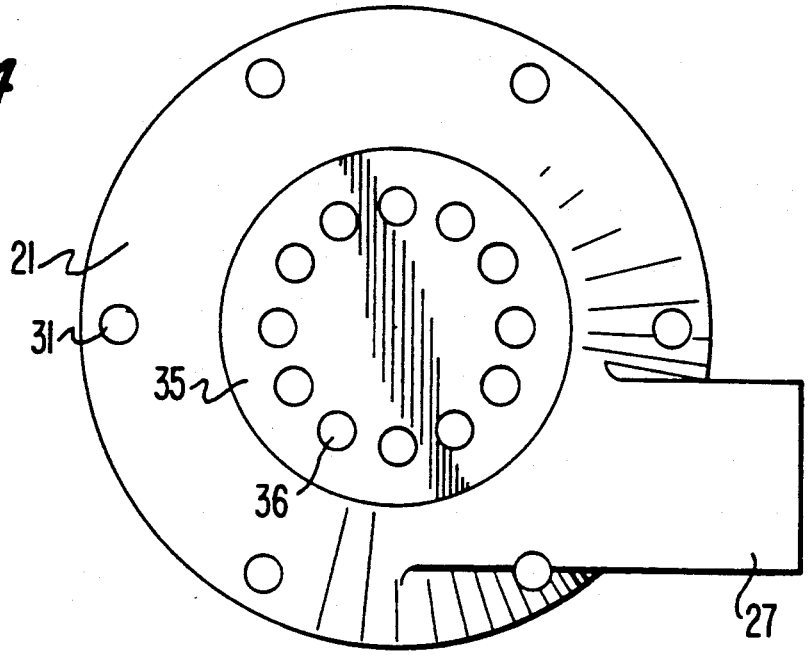
FIG. 4 is a bottom plan view of the distributor shown in FIG. 2.
Figure 5:
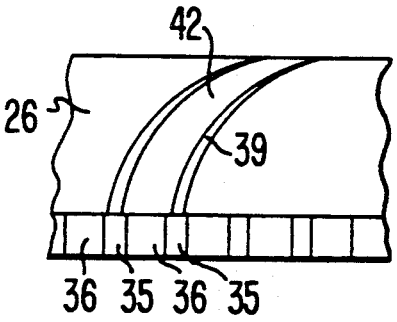
FIG. 5 is a partial view of the circular distributor chamber shown in FIG. 2 rolled out into a plane to illustrate the vane curvature.
Figure 6:
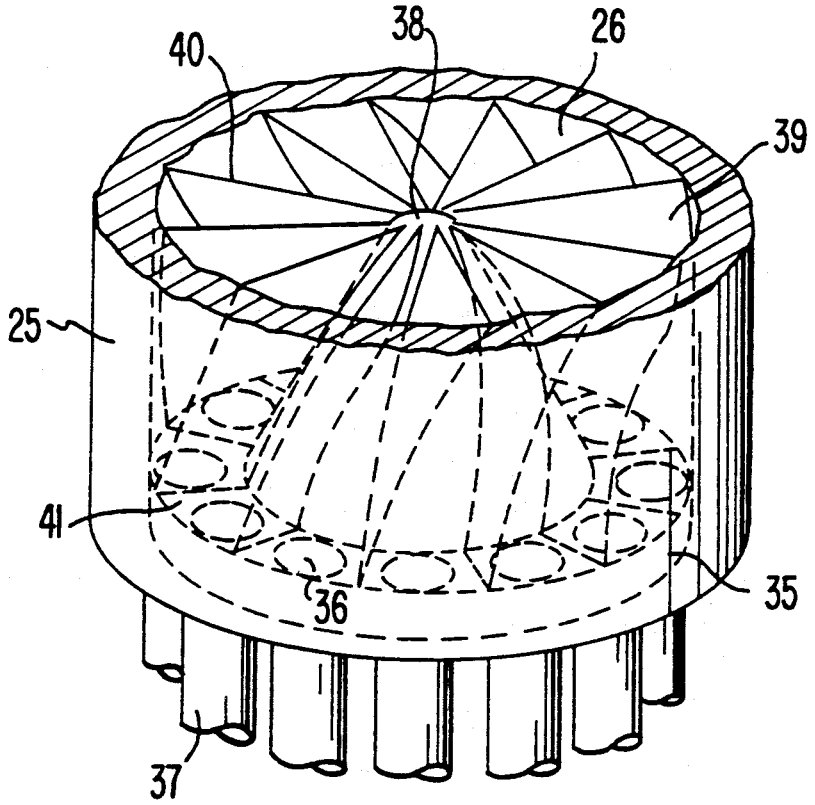
FIG. 6 is a perspective view of the distributor chamber portion of the distributor of FIG. 2 to show the curved vane section in more detail.

Referring now to the drawings and, in particular, to FIG. 2, the distributor designated generally by the numeral 20 comprises an upper body section 21 whose inner wall 22 defines a swirl chamber 23, a middle transition section 24 which is frusto-conical, and a cylindrical lower section 25 whose inner wall 26 defines a distributor chamber divided into pockets as will be more fully explained below.

An inlet conduit 27 is integrally joined with the upper body sections 21 and has a passage 28 which opens tangentially at the inner wall 22 of the swirl chamber 23 in the upper body section 21. A cover 29 is provided at the top of the upper body section 21 and is held in place by conventional fastening devices such as threaded bolts 30 which engage mating holes 31 in an outer portion 32 of the upper body section 21. A conventional elastomeric seal 33 can be provided in an annular recess 34 in the upper body section 21 to assure fluid-tightness of the distributor 20, while allowing access to the swirl chamber 23 through the removable cover 29. The lower section 25 has an axial end plate 35 provided with apertures 36 distributed evenly therearound. The apertures 36 are connected with conduits 37 which are associated with respective evaporator circuits (not shown). The end plate 35 can be in the form of an interchangeable plate which allows use of the distributor 20 with evaporators having a different number of heat exchange circuits.

A geometrical divider is comprised of a central conical hub 38 with curved vanes 39 extending to the inner wall 26 in the distributor chamber of the lower section 25. Each of the vanes 39 has a curvature along the longitudinal direction of the distributor chamber from a sharp leading edge 40 in a plane perpendicular to the longitudinal direction of the distributor 20 to a trailing edge 41 of the wall 35 equidistant between adjacent apertures 36 to assure that the vapor phase which has been separated from the liquid phase of the two-phase flow entering the distributor 20 through the passage 28 is evenly distributed to the apertures 36 in the bottom wall 35.

Liquid in the two-phase flow entering the chamber with sufficient velocity, e.g. 20 feet per second, from an expansion valve is centrifuged radially to the inner wall 22 of the swirl chamber 23, and the vapor phase separates due to its different density and tends to remain in the central portion of the swirl chamber. An even film of liquid builds up along the length of the inner wall 22 and descends toward the apertures 36 in the wall 35 where the liquid film is also evenly divided by the vanes 39 and then evenly forced through the holes. The liquid essentially covers each of the apertures 36, and vapor which has been evenly divided by the curved vanes 39 and guided in pockets 42 defined between adjacent vanes 39 is entrained with the liquid as they pass through the apertures 36.

While an embodiment in accordance with the present invention has been shown and described, it should be understood that the same is susceptible to changes and modifications without departing from the principles of the invention. Therefore, it is not intended that the invention be limited to the details described above but rather that all such changes and modifications as fall within the scope of the appended claims also be included.

We claim:

1. A centrifugal distributor for two-phase flow, comprising a housing having a swirl chamber with an inlet for admitting the two-phase flow into the swirl chamber which centrifugally separates a denser phase of the two-phase flow from another lesser density phase with the denser phase contacting a wall of the swirl chamber as the denser phase swirls in the housing, a plurality of apertures on an end wall of the housing remote from the inlet, and stationary guide vanes dividing the separated phases equally on a mass basis among the apertures and entraining the phase of lesser density with the denser phase as both phases pass into the apertures; and wherein the housing comprises a distributor chamber having a cylindrical inner wall in which the stationary guide vanes are located, a wall of the swirl chamber having one diameter and a wall of the distribution chamber having a second diameter smaller than the one diameter of the swirl chamber, and a frusto-conical transition section between the swirl chamber and the distribution chamber; and the stationary guide vanes have a leading edge which extends in a plane perpendicular to a longitudinal axis of the housing and are curved in the direction of the longitudinal axis.

2. A centrifugal distributor according to claim 1, wherein the curved guide vanes forming pockets in the distribution chamber in an area of the apertures.

3. A centrifugal distributor according to claim 1, wherein a conical hub is mounted centrally in the distribution chamber and the apertures are located along an annulus on an end wall defined between the wall of the distribution chamber and a base of the conical hub.

4. A centrifugal distributor according to claim 3, wherein the vanes extend from the wall of the distribution chamber to an outer wall of the hub.

5. A centrifugal distributor according to claim 4, wherein conduits of evaporator circuits are coupled to the apertures.

6. A centrifugal distributor according to claim 5, wherein the end wall of the housing comprises a removable plate.

7. A centrifugal distributor for two-phase flow, comprising a housing having a swirl chamber with an inlet for admitting the two-phase flow into the swirl chamber which centrifugally separates a denser phase of the two-phase flow from another lesser density phase with the denser phase contacting a wall of the swirl chamber as the denser phase swirls in the housing, a plurality of apertures on an end wall of the housing remote from the inlet, and stationary guide vanes dividing the separated phases equally on a mass basis among the apertures and entraining the phase of lesser density with the denser phase as both phases pass into the apertures; and wherein the denser phase is a liquid refrigerant which flows as a film on a wall of the swirl chamber toward the apertures;

the phase of lesser density is vapor refrigerant which flows in a central area of the swirl chamber toward the apertures;

the guide vanes are curved and from pockets in an housing in the area of the apertures;

the curved guide vanes having a leading edge which extends in a plane perpendicular to a longitudinal axis of the housing and the guide vanes are curved in the direction of the longitudinal axis;

the housing comprises a distributor chamber having a cylindrical inner wall in which curved stationary guide vanes are located, a wall of the swirl chamber having one diameter and a wall of the distribution chamber having a second diameter smaller than the one diameter of the swirl chamber, and a frusto-conical transition section between the swirl chamber and the distribution chamber; and a conical hub is mounted centrally in the distribution chamber and the apertures are located along an annulus on an end wall defined between the wall of the distribution chamber and a base of the hub.

8. A centrifugal distributor according to claim 7, wherein the vanes extend from the wall of the distribution chamber to an outer wall of the conical hub.

9. A centrifugal distributor according to claim 8, wherein conduits of evaporator circuits are coupled to the apertures.

10. A centrifugal distributor according to claim 9, wherein the end wall of the housing comprises a removable plate.

* * * * *